United States Patent [19]

Guiffray

[11] Patent Number: 4,709,821

[45] Date of Patent: Dec. 1, 1987

[54] CONTAINER SHAPED IN SUCH MANNER AS TO BE UNOVERTURNABLE FOR RECEIVING A LIQUID

[76] Inventor: Michel Guiffray, 136, rue Vulfran Warmé , 80000 Amiens, France

[21] Appl. No.: 934,876

[22] Filed: Nov. 25, 1986

[30] Foreign Application Priority Data

Nov. 26, 1985 [FR] France ..... 85 17456

[51] Int. Cl.[4] ..... B65D 23/00

[52] U.S. Cl. ..... 215/1 R; D9/367

[58] Field of Search ..... D9/371, 367, 305; 215/1 R, 1 C

[56] References Cited

U.S. PATENT DOCUMENTS

D. 183,433 8/1958 Van Baarn ..... 215/1 R

FOREIGN PATENT DOCUMENTS 0115990 8/1984 European Pat. Off. .

2318792 2/1977 France .

*Primary Examiner*—William Price

*Attorney, Agent, or Firm*—Sughrue, Mion, Zinn, Macpeak, and Seas

[57] ABSTRACT

A container of plastics material or other material for receiving a liquid formed by an extrusion-blowing process or by any other conventional process, comprising a neck (1) in which is formed an opening for expelling the liquid. The container comprises two sides each formed by a planar bearing portion (2A, 3A) and by a rounded portion (2B, 3B) connected to the planar portion and to the neck (1), the two planar portions forming a dihedron, and the two aforementioned bearing portions being interconnected by curved lateral portions (5). This arrangement renders the container unoverturnable, whatever be the position in which the container is placed on a support plane, and imparts thereto a maximum volume for a given amount of plastics material used in its manufacture.

14 Claims, 17 Drawing Figures

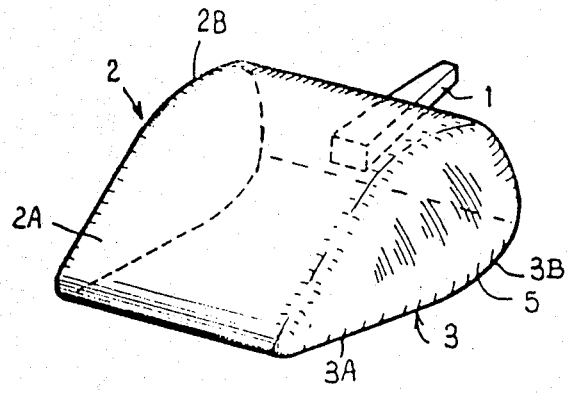
FIG.1
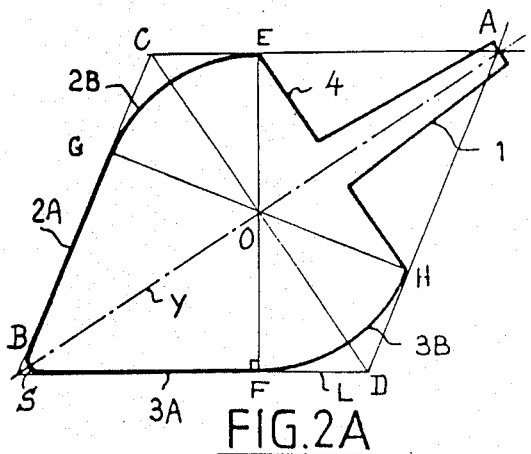
FIG.2A
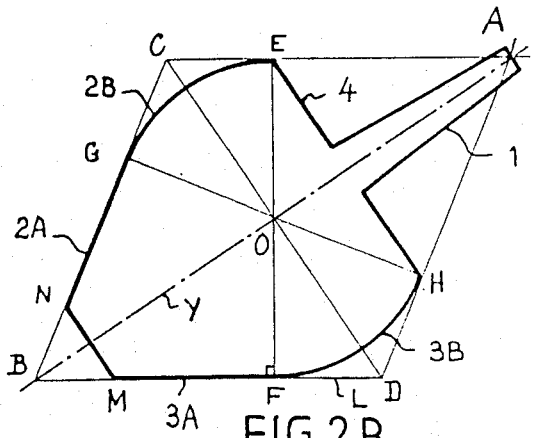
FIG.2B
FIG.4
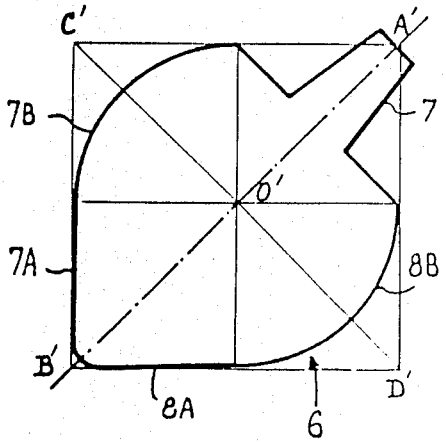
FIG.5
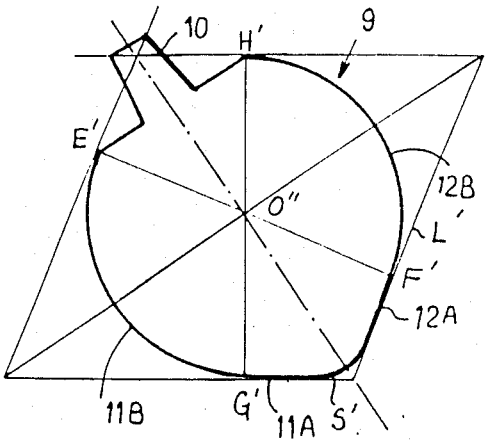

FIG.3
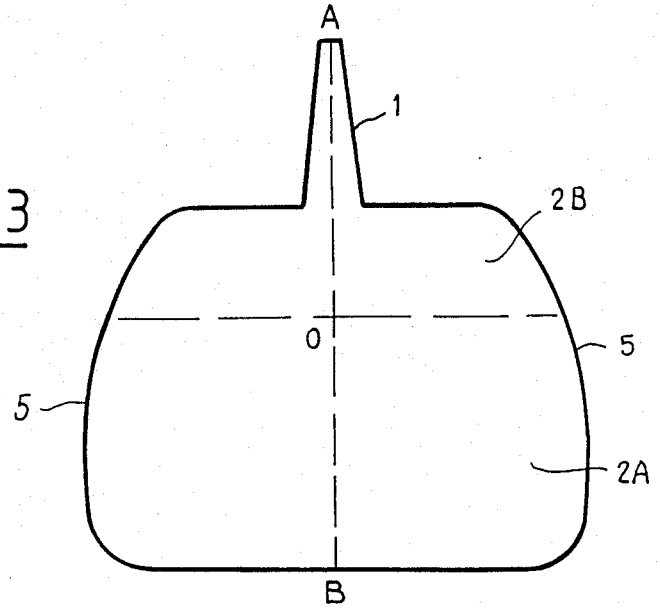
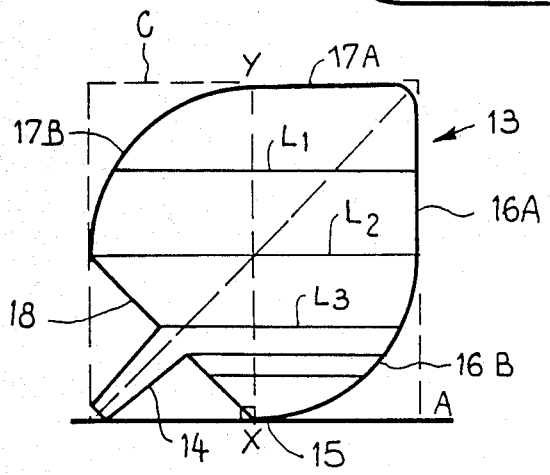
FIG. 6
FIG.7
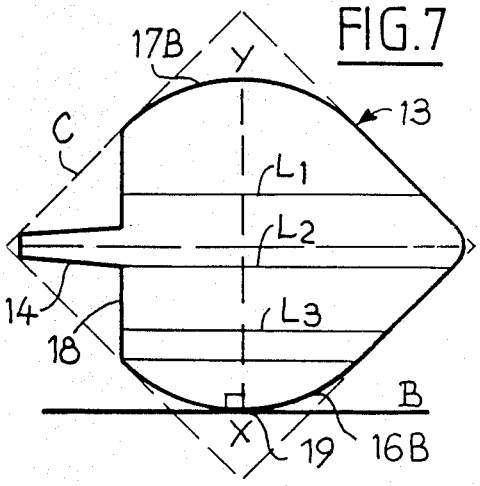
FIG.8
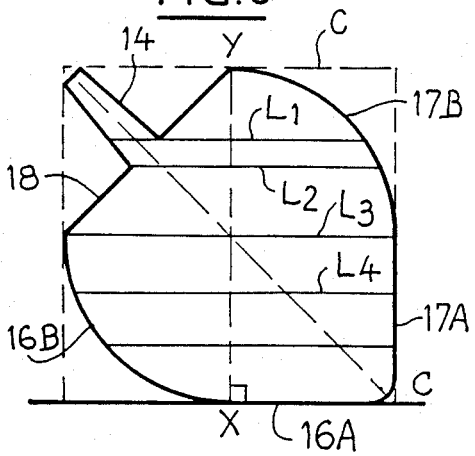

FIG.9
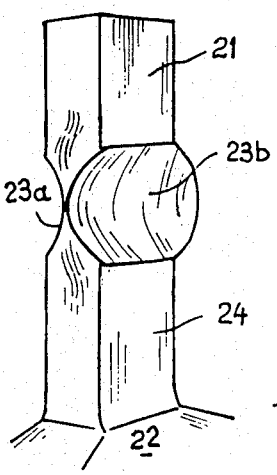
FIG.9A
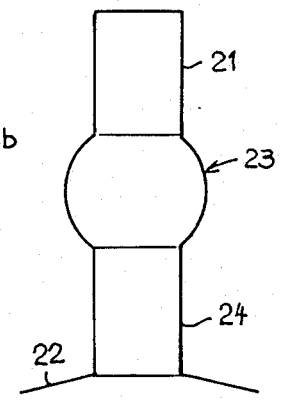
FIG.9B
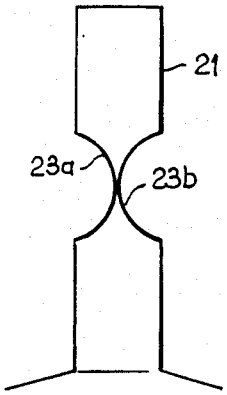
FIG.12
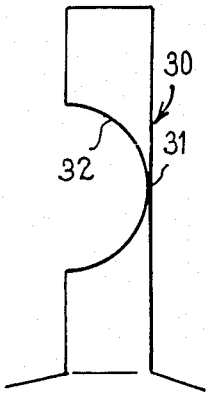
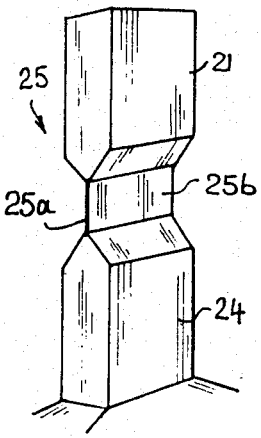
FIG.10
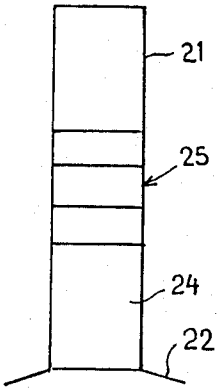
FIG.10A
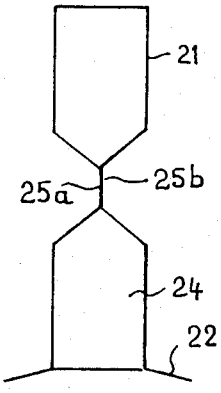
FIG.10B
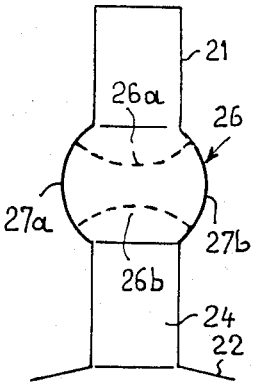
FIG.11

CONTAINER SHAPED IN SUCH MANNER AS TO BE UNOVERTURNABLE FOR RECEIVING A LIQUID

The present invention relates to a container of plastics material or other material (for example glass) for receiving a liquid.

French patent application No. 83 01 359 discloses a container of this type adapted to receive liquids such as cleaning or maintenance products, chemical products, etc. . . , which has two planar bearing sides forming a dihedron whose angle is less than 90° when the container is filled with liquid, these two planar sides being connected by a neck at the end of which is formed an opening for expelling the liquid.

The cost price of this container is considerably reduced owing to the simplification of its structure with respect to prior containers and, moreover, this container has the advantage of being unoverturnable, i.e. whatever the position in which it is placed on a horizontal planar surface, it necessarily rests on one of the planar sides of the dihedron with the liquid outlet opening facing upwardly. Thus, the liquid cannot accidentally flow out of the container after the neck has been opened.

An object of the present invention is to improve a container of this type by increasing its volume for a given quantity of raw material used in its manufacture.

The container of the invention, which is formed by an extrusion-blowing process or by any other conventional process, comprises a neck in which a liquid expelling opening is formed.

According to the invention, this container comprises two sides each formed by a planar bearing portion and by a rounded portion connected, on one hand, to the planar portion and, on the other hand, to the neck, the two planar portions forming a dihedron.

As the two planar portions are so dimensioned as to act as surfaces by which the container bears on a horizontal plane, the container can only assume one stable position on one of its two bearing sides, irrespective of the position in which it is placed on said horizontal plane. Further, the volume available for the liquid is distinctly greater than that of the aforementioned prior container owing to the provision of the rounded portions, which are for example spherical, for a given quantity of raw material which is substantially the same.

Further, the overall size of the container according to the invention is smaller relative to the container of the French patent application No. 83 01 359, and therefore affords improved storing facilities.

Further features and advantages of the invention will be apparent from the following description with reference to the accompanying drawings which illustrate, by way of non-limiting examples, several embodiments thereof. In the drawings:

FIG. 1 is a perspective view of a first embodiment of the container according to the invention;

FIG. 2A is a cross-sectional view taken on the axis of the neck of the container of FIG. 1;

FIG. 2B is a cross-sectional view of a variant of the first embodiment;

FIG. 3 is a top plan view of the container of FIGS. 1 and 2A;

FIGS. 4 and 5 are cross-sectional views similar to FIG. 2A of two other embodiments of the container according to the invention;

FIGS. 6, 7 and 8 are views similar to FIG. 2 of a fourth embodiment of the container, shown in several different positions on a horizontal plane;

FIG. 9 is a perspective view, and

FIGS. 9A and 9B are partial elevational views respectively in two perpendicular planes, of a first embodiment of the neck of a container and of its closure;

FIGS. 10, 10A and 10B are views similar to FIGS. 9, 9A and 9B of a first variant of the construction of the neck and its closure;

FIG. 11 is an elevational view of a second variant of the neck of FIG. 9A, and

FIG. 12 is a side elevational view of a third simplified variant of the construction of the neck of FIG. 9B.

The container shown in FIGS. 1 to 3 is made from a suitable material, such as a plastics material, a complex material, glass, etc..., and is adapted to receive a liquid such as for example a domestic cleaning or maintenance product.

This container, which is formed by an extrusion-blowing process or by any other conventional process, comprises a neck 1 in which is formed an opening through which the liquid is expelled, and two sides 2, 3 each formed by a planar bearing portion 2A, 3A respectively and by a rounded portion, for example a spherical portion, 2B, 3B, respectively connected, on one hand, to the corresponding planar portion 2A, 3A and, on the other hand, to the neck 1 through a planar portion 4, the two planar portions 2A, 3A forming a dihedron whose angle is less than 90° in the presently-described embodiment.

The section of the container in a plane perpendicular to the planar portions 2A, 3A, i.e. in the plane of FIG. 2A, is inscribed, in the embodiment of FIGS. 1 to 3, within a diamond L, having angles A, B, C, D, the neck 1 however extending slightly beyond this diamond so that its edges intersect the extensions of the sides of said diamond beyond the angle A. In a modification, the neck 1 may of course be either completely inscribed within the diamond L or extend further outside the diamond than shown in FIG. 2A.

Thus, in a plane perpendicular to the planar portions 2A, 3A, the bottle or container has, from the top of the neck 1 to the apex S of the dihedron 2A, 3A, two contours which are symmetrical relative to the large diagonal Y joining the apices A and B of the diamond L, on which is preferably moreover located the centre of curvature O of the spherical portions 2B and 3B. In other words, the large diagonal Y of the diamond L constitutes, in section, the axis of symmetry of the two halves of the container. Thus, the bottom 2A, 2B of which the apex S is preferably rounded, is inscribed within one of the angles of the diamond while the neck 1 is placed in the opposite angle (or slightly beyond this angle).

Irrespective of the level of the liquid it contains, the bottle or container always has its centre of gravity offset toward the bottom 2A or 3A on which it bears, to the rear of the verticals E F or G H (FIG. 2A) drawn from points of contact F (or G) of the rounded portion 3B (or 2B) with the planar surface adjacent 3A (or 2A) on which it is placed. In this way, irrespective of the manner in which the container is placed on the surface, it is always constrained, under the effect of its own weight and under the effect of the mass of liquid it contains, to stabilize itself on one of its planar portions 2A or 3A after having tipped on its truncated rounded portions 3B or 2B. In its stabilized position, the container always maintains the opening of its neck 1 above the level of the liquid it contains so that the latter cannot flow out of the container merely under the effect of gravity.

The two arcs of a circle GE and FH of a section of the container in the plane of FIG. 2A are inscribed within the diamond L and have for common centre O which is the point of intersection of the two diagonals AB and CD of the container. These arcs of a circle GE and FH interconnect in pairs the opposite sides of the angles in which are respectively inscribed the bottom 2A, 3A and the neck 1 of the bottle or container. The planar portion 4 perpendicularly intersects the diagonal AB and is connected to the rounded portions 2B, 3B by the points E and H.

As a variant, the arcs of a circle GE and FH may be replaced by non-circular curves, whose function of course remains identical. Likewise, the geometry of the neck 1 may greatly vary.

There may also be provided, instead of a rounded apex S connecting the planar portions 2A, 3A, a truncation of the latter in a segment NM (FIG. 2B). The planar portions 2A, 3A may also be replaced by a conical structure which may be provided with facets or flat surfaces.

According to a feature of the invention, the two portions 2A, 2B, and 3A, 3B are interconnected by rounded lateral portions 5 (FIG. 1). Thus the container cannot be placed on one of its edges or lateral sides 5 and is on the contrary made to position itself on one of the two bearing surfaces 2A, 2B, or 3A, 3B if it is placed on one of the surfaces 5.

Apart from the aforementioned features, the container may have various other forms; however, the end S of the bottom, which is preferably rounded or possibly truncated at NM, must be located as close as possible to the apex of the adjacent angle of the diamond L.

The second embodiment illustrated in FIG. 4 differs from the preceding embodiment in that the container 6 is here inscribed in section within a square A', B', C', D', and the neck 7, whose end extends slightly beyond the upper angle of this square, is distinctly shorter than the neck 1. The planar portions 7A and 8A here extend on one half of the sides of the square and are connected to portions 7B, 8B of circular section whose common centre O is located at the intersection of the diagonals A'B' and C'D' of the square.

In the third embodiment shown in FIG. 5, the container 9 is inscribed within a diamond L', and its planar portions 11A and 12A, which define a dihedron whose angle exceeds 90° and are interconnected by a rounded apex S', are connected to the respective spherical portions 11B and 12B at the points G' and F'. The latter are formed by the intersections of the corresponding sides of the diamond L' with the straight lines H'G' and E'F' perpendicular to its sides and passing through the centre O'' of the spherical portions 11B, 12B, the container being provided with a short neck 10.

It can be seen that the planar portions 11A, 12A are here distinctly smaller than the planar portions of the foregoing embodiments.

The fourth embodiment of the container 13 illustrated in FIGS. 6 to 8 is inscribed in section in a vertical plane within a square C. In FIG. 6, the container 13 is placed in a position in which it bears on its neck 14 and on its edge 15 connecting its rounded portion 16B to the planar portion 18 connected to the neck 14, this container having two planar portions 16A, 17A and a second rounded portion 17B. The vertical XY passing through the point 15 and through the centre of curvature of the rounded portions 16B, 17B divides the container into two volumes, the right volume filled with liquid being larger than the volume filled with this liquid on the left side of the vertical XY, irrespective of the level of the liquid L1, L2, L3, . . . , owing to the geometrical characteristics of the container according to the invention. Consequently, this position of the container 13 is not stable and it automatically tends to tip in order to place itself in the position of FIG. 8, in which it bears on one of the planar portions 16A, 17A after having rolled over on the corresponding rounded portion; in the present instance, the container 13 bears on its planar portion 16A in FIG. 8 in which it is stable. This is explained by the fact that, irrespective of the level of the liquid (L1, L2, L3, L4 . . .), the volume of liquid located in the part of the container opposed to its neck 14 and defined by the vertical XY is larger than the volume of liquid located on the other side of this vertical XY, so that the stability of the container is ensured on either one of its planar bearing surfaces 16A or 17A.

Likewise, if the container is made to bear by one of its spherical portions 16B or 17B on a horizontal plane (FIG. 7), the volume of liquid located between the vertical XY passing through the bearing line 19 defined by the middle of the rounded portion 16B (or 17B) and the planar portions 16A, 17A, is greater than the volume of liquid contained in the part of the container located on the other side of the vertical XY, i.e. between the latter and the neck 14. Consequently, the container 13 automatically tips over on its rounded portion 16B (or 17B) so as to position itself in its stable position of FIG. 8 in which its neck 14 is oriented upwardly.

Thus, all the containers satisfying the characteristics defined by the invention are unoverturnable and automatically place themselves in one of their two stable positions, irrespective of the position in which they are placed on a support plane (except for the FIG. 2B variant which may be placed on its truncated base NM to be filled with liquid). This is of course also true when the container is placed in a position to bear on one of its rounded lateral surfaces 5.

For containers produced from flexible or semi-rigid materials, there is shown in FIGS. 9, 9A and 9B an embodiment of the neck of the container in which the spout or opening 21 communicates with the body 22 of the container through a closure 23 and a neck 24. The closure 23 is formed by two wall portions *23a*, *23b* which are so shaped as to bear elastically against each other and close the container, these portions *23a*, *23b* being hemi-spherical in the presently-described embodiment. They may be separated from each other by the passage of the liquid therebetween when a sufficient pressure is exerted on the sides of the container, and elastically return to the position in which they are applied against each other as soon as this pressure ceases. Thus, these curved portions *23a*, *23b*, close in the manner of lips owing to the elastic effect of their shape. This elastic effect is produced by the reaction of the wall of the neck 24 with respect to forces transmitted thereto at a certain angle by the curved shapes *23a*, *23b*.

In the embodiment shown in FIGS. 10, 10A and 10B the closure 25 is formed by two wall portions *25a*, *25b* having a broken line contour and, more particularly in this embodiment, in the form of a trapezium whose small bases are elastically applied against each other. These small bases may be elastically separated when a sufficient pressure is exerted on either of the walls of the container or on both of these walls and return to the position in which they are applied against each other and close the container in a fluidtight manner when this pressure ceases. In the embodiment of FIG. 11, the upper edges *26a, 26b* of the closure 26 have convex contours in confronting relation to each other, the lateral edges *27a, 27b* being rounded as in the case of the closure 23.

In the embodiment of FIG. 12, the closure 30 is formed by a planar wall portion 31 and a curved wall portion 32 which is in the presently-described embodiment hemi-spherical, these two portions being applied in the presently-described embodiment one against the other.

What is claimed is:

1. A container adapted to receive a liquid comprising a neck, an opening in the neck for expelling the liquid, two sides each comprising a planar bearing portion and a rounded portion connected to the planar portion and to the neck, the two planar portions forming a dihedron, and rounded lateral portions interconnecting said two bearing portions.

2. A container according to claim 1, wherein a part of the container substantially without the neck has a section in a plane perpendicular to said planar portions which is inscribed within an equilateral parallelogram.

3. A container according to claim 2, wherein at least an end portion of the neck extends beyond said parallelogram.

4. A container according to claim 1, wherein the container has a section in a plane perpendicular to said planar portions which is inscribed within an equilateral parallelogram.

5. A container according to claim 2, wherein said equilateral parallelogram is a diamond.

6. a container according to claim 4, wherein said equilatral parallelogram is a diamond.

7. A container according to claim 2, wherein said equilateral parallelogram is a square.

8. A container according to claim 4, wherein said equilateral parallelogram is a square.

9. A container according to claim 1, comprising a planar portion which connects the neck to the spherical portions.

10. A container according to claim 1, made from a deformable material, wherein the neck comprises two wall portions which are so shaped and positioned as to be elastically applied against each other so as to close the container and which are capable of being separated from each other so as to allow the liquid to pass therebetween when a pressure is exerted on the sides of the container and are capable of elastically returning to the position in which they are applied against each other as soon as the pressure ceases.

11. A container according to claim 10, wherein the shaped wall portions of the neck have a semi-cylindrical shape.

12. A container according to claim 10, wherein the shaped wall portions of the neck have a broken line shape in section.

13. A container according to claim 10, wherein said material is flexible.

14. A containr according to claim 10, wherein said material is semi-rigid.

* * * * *